US010336422B1

(12) United States Patent
Hiers

(10) Patent No.: US 10,336,422 B1
(45) Date of Patent: Jul. 2, 2019

(54) PEDAL-DRIVEN BOAT AND FISHING PLATFORM

(71) Applicant: Richard E. Hiers, Summerville, SC (US)

(72) Inventor: Richard E. Hiers, Summerville, SC (US)

( * ) Notice: Subject to any disclaimer, the term of this patent is extended or adjusted under 35 U.S.C. 154(b) by 0 days.

(21) Appl. No.: 16/045,809

(22) Filed: Jul. 26, 2018

(51) Int. Cl.

| | |
|---|---|
| ***B63B 5/02*** | (2006.01) |
| ***B63H 5/02*** | (2006.01) |
| ***B63H 16/20*** | (2006.01) |
| ***B63B 5/24*** | (2006.01) |
| ***B63B 7/00*** | (2006.01) |
| ***B63B 35/14*** | (2006.01) |
| ***B63B 13/00*** | (2006.01) |
| ***B63B 7/02*** | (2006.01) |

(52) U.S. Cl.
CPC ..... *B63H 5/02* (2013.01); *B63B 5/02* (2013.01); *B63B 5/24* (2013.01); *B63B 7/00* (2013.01); *B63B 7/02* (2013.01); *B63B 13/00* (2013.01); *B63B 35/14* (2013.01); *B63H 16/20* (2013.01); *B63B 2005/245* (2013.01); *B63B 2005/247* (2013.01); *B63B 2007/003* (2013.01)

(58) Field of Classification Search
CPC ..... B63H 5/02; B63B 5/02
See application file for complete search history.

(56) References Cited

U.S. PATENT DOCUMENTS

| | | | | |
|---|---|---|---|---|
| 4,140,076 A * | 2/1979 | Borglum | B63B 13/00 | 114/283 |
| 4,493,658 A * | 1/1985 | Hildebrand | B63H 16/12 | 114/61.1 |
| 4,496,325 A * | 1/1985 | Tweg | B63B 1/121 | 114/354 |
| 4,772,237 A * | 9/1988 | Zalkauskas | B63H 1/34 | 440/30 |
| 5,194,023 A * | 3/1993 | Stone | B63H 16/08 | 440/20 |
| 5,381,752 A * | 1/1995 | Eerdmans | B60F 3/0007 | 440/12.62 |
| 5,427,554 A * | 6/1995 | Foglia | B63B 35/73 | 114/39.21 |
| 5,590,616 A * | 1/1997 | Vera | B63B 1/14 | 114/261 |
| 5,626,501 A * | 5/1997 | He | B63B 35/73 | 114/283 |
| 5,722,865 A * | 3/1998 | Tatum | B63B 39/06 | 440/12 |
| 5,988,092 A * | 11/1999 | Price | B63H 5/02 | 114/162 |
| 6,083,062 A * | 7/2000 | Treloar | B63H 16/12 | 114/354 |

(Continued)

FOREIGN PATENT DOCUMENTS

GB 1074609 A * 7/1967 ..... B63B 7/04

*Primary Examiner* — S. Joseph Morano
*Assistant Examiner* — Jovon E Hayes
(74) *Attorney, Agent, or Firm* — Thrive IP®

(57) ABSTRACT

A boat comprises a deck supported by one or more deck floats, and a paddle wheel cockpit comprising a seat proximal to a pedal-driven paddle wheel adapted to engage water and propel the boat; wherein the deck and the paddle wheel cockpit are joined by at least one cockpit hinge that allows the paddle wheel cockpit to fold over the deck, in some embodiments.

18 Claims, 16 Drawing Sheets

(56) References Cited

U.S. PATENT DOCUMENTS

| | | | | |
|---|---|---|---|---|
| 6,264,518 | B1 * | 7/2001 | Price | B63H 5/02 114/162 |
| 6,691,633 | B1 * | 2/2004 | Metzger | B63B 7/082 114/162 |
| D544,429 | S | 6/2007 | Farber et al. | |
| 8,668,536 | B1 | 3/2014 | Burnham | |
| 2003/0192465 | A1 * | 10/2003 | Roodenburg | B63B 1/12 114/330 |
| 2012/0171910 | A1 * | 7/2012 | Schramer | B60V 1/043 440/12.51 |

* cited by examiner

PEDAL-DRIVEN BOAT AND FISHING PLATFORM

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF INVENTION

This invention relates to vessels that float on water and can serve as boats, decks, docks, recreational platforms, and work platforms on the water.

BACKGROUND OF THE INVENTION

Boats for recreation and for working on the water are known. Small craft, such as paddle boards, kayaks, canoes, and rowboats, each powered by human effort, also are known. There exists a gap, however, between motor-driven boats that can carry numerous people and significant equipment, on the one hand, and the small craft that are powered by human effort. Boats are needed that allow recreational and operational opportunities beyond those provided by small craft, and yet avoid the sometimes-prohibitive expense of motor-driven craft.

SUMMARY OF THE INVENTION

Unexpectedly, Applicant has invented a class of boats that can achieve significant capabilities on the water. Some boats provide a small, human-powered platform that is transportable on a suitable trailer over land, and yet avoids the significant weight and costs attendant with motor-powered boats. Other boats provide scalable platforms for playing or working on the water, allowing multiple decks to be attached together, moved to a desirable fishing hole or worksite, anchored for a time, and then moved back to land. Accordingly, some embodiments of the present invention relate to boats, one such boat comprising a deck supported by one or more deck floats, and a paddle wheel cockpit comprising a seat proximal to a pedal-driven paddle wheel adapted to engage water and propel the boat;

wherein the deck and the paddle wheel cockpit are joined by at least one cockpit hinge that allows the paddle wheel cockpit to fold over the deck.

Further embodiments relate to a boat, comprising:

a central deck supported by one or more deck floats, the central deck comprising a paddle wheel cockpit having a plurality of seats and a plurality of pedal-driven paddle wheels adapted to engage water and propel the boat, each seat in the plurality of seats being proximal to one pedal-driven paddle wheel in the plurality of pedal-driven paddle wheels, optionally there being an equal number of seats and pedal-driven paddle wheels;

one or more rudders positioned to navigate the boat, the one or more rudders being connected to at least one tiller positioned within arm's reach of at least one seat in the plurality of seats or within arm's reach of a person on the central deck, or both;

the central deck having a left edge and a right edge;

a left deck supported by one or more left floats;

a right deck supported by one or more right floats;

wherein the left deck attaches to the central deck at the left edge by at least one left hinge that allows the left deck to fold over the central deck; and wherein the right deck attaches to the central deck at the right edge by at least one right hinge that allows the right deck to fold over the central deck.

Still other embodiments relate to a boat, comprising:

a central deck supported by one or more deck floats, the central deck defining a front edge opposite a rear edge, and a left edge opposite a right edge and between the front edge and the rear edge;

a paddle wheel cockpit comprising a plurality of seats and a plurality of pedal-driven paddle wheels adapted to engage water and propel the boat, each seat in the plurality of seats being proximal to one pedal-driven paddle wheel in the plurality of pedal-driven paddle wheels, optionally there being an equal number of seats and pedal-driven paddle wheels;

a left deck supported by one or more left floats; and a right deck supported by one or more right floats;

wherein the paddle wheel cockpit attaches to the central deck at the front edge or the rear edge by at least one cockpit hinge that allows the paddle wheel cockpit to fold over the central deck;

wherein the left deck attaches to the central deck at the left edge by at least one left hinge that allows the left deck to fold over the central deck; and wherein the right deck attaches to the central deck at the right edge by at least one right hinge that allows the right deck to fold over the central deck.

Yet additional embodiments relate to a boat, comprising:

a central deck supported by one or more deck floats, the central deck defining a front edge opposite a rear edge, and a left edge opposite a right edge and between the front edge and the rear edge;

a left deck supported by one or more left floats, the left deck further comprising a left cockpit comprising at least one left seat proximal to at least one left pedal-driven paddle wheel adapted to engage water and propel the boat;

a right deck supported by one or more right floats, the right deck further comprising a right cockpit comprising at least one right seat proximal to at least one right pedal-driven paddle wheel adapted to engage water and propel the boat;

wherein the left deck attaches to the central deck at the left edge by at least one left hinge that allows the left deck to fold over the central deck; and wherein the right deck attaches to the central deck at the right edge by at least one right hinge that allows the right deck to fold over the central deck.

Still further embodiments provide a boat, comprising:

a plurality of decks supported by a plurality of deck floats, each deck in the plurality of decks joined to at least one other deck in the plurality of decks;

a paddle wheel cockpit comprising one or more seats proximal to one or more pedal-driven paddle wheels, the paddle wheel cockpit being connected to at least one deck in the plurality of decks.

While the disclosure provides certain specific embodiments, the invention is not limited to those embodiments. A person of ordinary skill will appreciate from the description herein that modifications can be made to the described embodiments and therefore that the specification is broader in scope than the described embodiments. All examples are therefore non-limiting.

DETAILED DESCRIPTION

Figure 1:
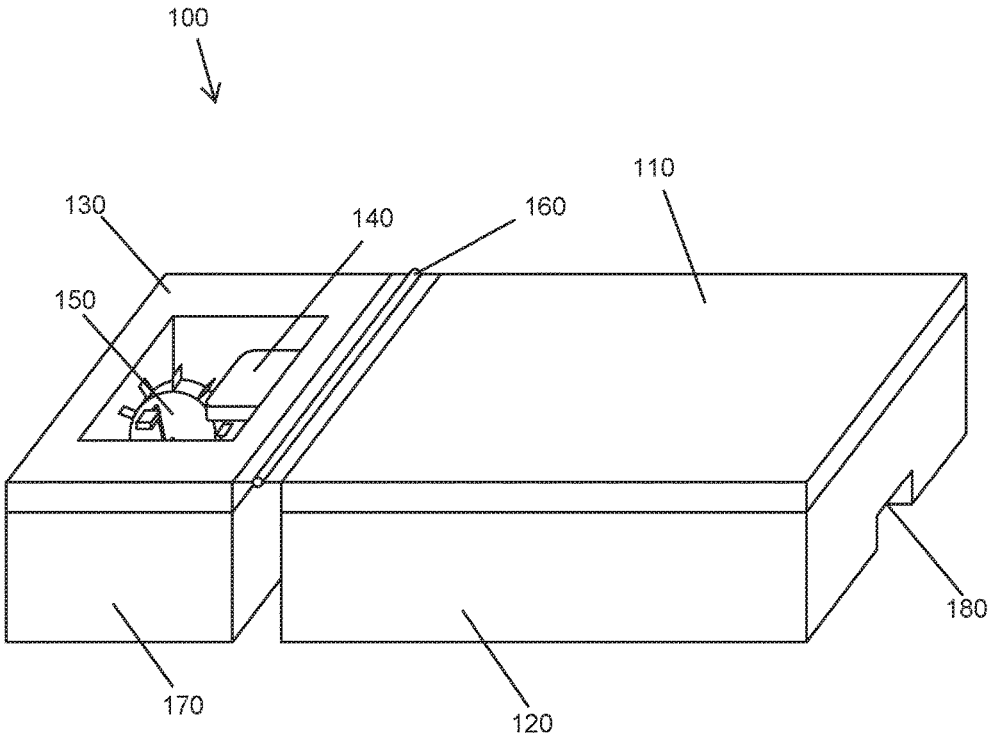
FIGS. 1-3 show, in one embodiment of the invention, boat 100.

As required, detailed embodiments of the present invention are disclosed herein; however, it is to be understood that the disclosed embodiments are merely exemplary of the invention that may be embodied in various forms. The figures are not necessarily to scale, and some features may be exaggerated to show details of particular components. Therefore, specific structural and functional details disclosed herein are not to be interpreted as limiting, but merely as a basis for the claims and as a representative basis for teaching one skilled in the art to variously employ the present invention.

Unless defined otherwise, all technical and scientific terms used herein have the same meaning as is commonly understood by one of ordinary skill in the art to which this disclosure belongs. In the event that there is a plurality of definitions for a term herein, those in this section prevail unless stated otherwise.

Where ever the phrase "for example," "such as," "including" and the like are used herein, the phrase "and without limitation" is understood to follow unless explicitly stated otherwise. Similarly "an example," "exemplary" and the like are understood to be non-limiting.

The term "substantially" allows for deviations from the descriptor that don't negatively impact the intended purpose. Descriptive terms are understood to be modified by the term "substantially" even if the word "substantially" is not explicitly recited.

The term "about" when used in connection with a numerical value refers to the actual given value, and to the approximation to such given value that would reasonably be inferred by one of ordinary skill in the art, including approximations due to the experimental and or measurement conditions for such given value.

The terms "comprising" and "including" and "having" and "involving" (and similarly "comprises", "includes," "has," and "involves") and the like are used interchangeably and have the same meaning. Specifically, each of the terms is defined consistent with the common United States patent law definition of "comprising" and is therefore interpreted to be an open term meaning "at least the following," and is also interpreted not to exclude additional features, limitations, aspects, etc. Thus, for example, "a device having components a, b, and c" means that the device includes at least components a, b and c. Similarly, the phrase: "a method involving steps a, b, and c" means that the method includes at least steps a, b, and c.

Unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Any discussion of the prior art throughout the specification should in no way be considered as an admission that such prior art is widely known or forms part of common general knowledge in the field.

It is an object of the present invention to overcome or ameliorate at least one of the disadvantages of the prior art, or to provide a useful alternative.

In one embodiment, a boat comprises a deck supported by one or more deck floats, and a paddle wheel cockpit comprising a seat proximal to a pedal-driven paddle wheel adapted to engage water and propel the boat; wherein the deck and the paddle wheel cockpit are joined by at least one cockpit hinge that allows the paddle wheel cockpit to fold over the deck. As used herein, a deck supported by one or more deck floats indicates a surface suitable for standing, walking, sitting, and lying down supported by one or more enclosed volumes that provide buoyancy. Hinges can be used in the context of the present invention to join two components such as a deck and a cockpit, or two decks, so that the two components can be folded one over the other for ease in transportation and storage. Joining by a hinge can be "permanent," requiring significant tools and effort to unjoin; or such joining can be "temporary," or easily reversed to facilitate transportation and storage of the boat when not in use. When two components such as a deck and a cockpit are joined by a hinge, any suitable method can be used to secure those two components relative to each other. For example, a boat can use at least one locking bar adapted to secure the paddle wheel cockpit relative to the deck in a deployed position.

Certain embodiments of the present invention allow for boats comprising a pedal-driven paddle wheel cockpit within a deck. Or the cockpit can appear as a separate unit that can be disjoined from or folded over a deck. If the cockpit is a separate unit joined by one or more hinges, the cockpit can appear at the front of the boat or at the back of the boat as may be desired, in some cases. In other cases, a cockpit can be arranged at the side of a boat. In still other cases, an even number of cockpits can appear along both sides of a boat.

A deck, indicating the upper surface of the boat, can be supported by floats under some or all of the surface area of the deck. Similarly, a paddle wheel cockpit can be supported by one or more cockpit floats. Sometimes, a portion of the deck will have no float immediately below it. Other times, the floats will form a channel that eases the passage of water from a pedal-driven paddle wheel, thereby reducing the resistance of the boat to moving through the water. Such a channel also can act as a kind of keel, assisting the navigation of the boat through the water. Accordingly, in certain cases, the one or more floats define a channel that extends from the pedal-driven paddle wheel underneath the boat.

Propulsion, in certain instances of the present invention, is provided by one or more pedal-driven paddle wheels. That means a seat is positioned proximal to a paddle wheel so that a person sitting on the seat can drive the pedals with the feet in a manner similar to riding a bike. Optionally, the seat position and/or the position of the paddle wheel can be adjusted to accommodate the size of the person peddling the paddle wheel. As the paddle wheel turns, paddles engage the water, thereby pushing the boat over the water. The paddle wheel cockpit can be designed to keep the paddler as dry as possible, or to allow the paddler to enjoy the water as desired. Optionally, propulsion can be provided by any suitable means other than paddle wheels. Paddles worked by the arms, poles pushing off a lake bottom, oars, sails, electric motors, gasoline-power motors, diesel-powered motors, and the like may be mentioned. Propulsion means can be used alone or in combination as desired. Accordingly, a boat may include a transom adapted to support an electric motor, an outboard motor, or both. The transom can be located in any suitable location. For example, the transom can be located on the deck, on the paddle wheel cockpit, or both.

Navigational control can be provided by any suitable means. In some cases, a boat further comprises at least one rudder joined to a tiller positioned within arm's reach of the seat. As used herein, arm's reach means that a person can comfortably reach and manipulate the tiller. Arm's reach can mean within one foot, within two feet, within three feet, or within four feet, in some cases. In further cases, a single rudder engages the water to steer the boat. In other cases, more than one rudder engages the water, yet each of those rudders are joined to a single tiller. Still other cases provide a plurality of independently-controlled rudders. Optionally, a boat may include one or more rudder guards, which are structural components placed to protect the rudder should the boat encounter foreseeable obstacles such as docks and other boats.

Any suitable additional equipment can be included with the boats of the present invention. To aid swimmers, for example, a boat may further comprise a ladder extending from the deck, the ladder comprising a ladder brace that engages the one or more floats to stabilize the ladder. As can be appreciated, a person climbing out of the water may push the bottom portion of a ladder underneath the boat, if the latter is not properly stabilized. A ladder brace can allow that stabilization.

In addition, some instances of the present invention allow for a roof attached to and covering at least a portion of the deck. The roof can be attached in any suitable manner. For example, the deck can have receiving slots that allow roof poles to engage the deck and support a roof structure over the deck or a portion thereof. Further instances allow for one or more walls temporarily or permanently attached to a deck, a paddle wheel cockpit, or both. In some cases, a wall prevents waves washing over a boat and removing equipment and belongings from the boat.

Still other instances allow for the use of one or more ballast tanks. In some cases, a ballast tank comprises an enclosed volume for holding water, the enclosed volume having an upper portion and a lower portion; an input port for adding water at the upper portion; an outlet port for draining water from the lower portion; and at least one brace for attaching the ballast tank to the boat. Any suitable material can be used for the ballast tank, such as polymer, metal, and combinations thereof. Interestingly, the use of ballast tanks affords a number of advantages. First, the boat can be stabilized by the deployment of ballast tanks. Moreover, the buoyancy and deck height above the waterline can be adjusted. If a boat of the present invention is used as a work surface for a dock builder, for example, ballast can be lessened to allow the dock builder to access the railing and upper structures of the dock; ballast can be added to allow the dock builder to access lower structures of the dock. When the boat is removed from the water, the ballast tanks can be drained for lighter weight. Also, weights, such as iron, steel, lead, rock, sand, and the like, can be used as ballast. In some cases, a metal sheet appearing above or below the floats can function as ballast.

The boats of the present invention can be built of any suitable materials. For example, a boat may comprise wood, polymer, metal, or combinations thereof. Among wood, teak may be mentioned. Among polymers, high density polyethylene can be used. Among metals, stainless steel, aluminum, or combinations thereof can appear. In some cases, the deck comprises a high density polyethylene textured to reduce slipperiness when wet. The floats supporting the deck can include stainless steel or aluminum tubing such as those included in pontoon boats. Sturdy high density polyethylene floats also may be mentioned. Polymer floats are more easily shaped in molding for a desirable shape, to include a channel, and the like. Components of a boat may be joined in any suitable fashion, such as by screws, bolts, adhesives, clamps, snap-together tabs and slots, each alone or in combination.

Boats of the present invention can have any suitable dimensions. For example, a deck can be two feet, three feet, four feet, five feet, six feet, seven feet, eight feet, nine feet, ten feet, or over ten feet wide. A deck can be two feet, three feet, four feet, five feet, six feet, seven feet, eight feet, nine feet, ten feet, or over ten feet long. A paddle wheel cockpit can be two feet, three feet, four feet, five feet, six feet, seven feet, eight feet, nine feet, ten feet, or over ten feet wide. A paddle wheel cockpit can be two feet, three feet, four feet, five feet, six feet, seven feet, eight feet, nine feet, ten feet, or over ten feet long. A boat can have any suitable buoyancy as well. A boat can have more than 100 lbs., more than 250 lbs., more than 500 lbs., more than 1000 lbs., more than 5,000 lbs., more than 10,000 lbs., or more than 20,000 lbs. net buoyancy. Or, a boat can have less than 100 lbs., less than 250 lbs., less than 500 lbs., less than 1000 lbs., less than 5,000 lbs., less than 10,000 lbs., or less than 20,000 lbs. net buoyancy. As used herein, net buoyancy means the additional weight a boat can take on while maintaining the deck above water.

Boats of the present invention can be made according to any suitable process. Individual components can be injection molded, blow molded, stamped, milled, welded, and shaped as needed. Then the components can be joined as desired, as explained above. Certain instances provide for a virtually-limitless joining of decks to create any desired size of boat. Of course, propulsion of an extraordinarily large boat with human-powered paddle wheels will become pointless; towing, motoring, or a combination thereof may be required to position the boat at the desired site.

A boat of the present invention can be used for any suitable purpose. For example, a family can paddle out to their favorite fishing hole. In another example, a dock builder can achieve a stable platform from which to build a dock. Optionally, the floats supporting one or more decks and/or the paddle wheel cockpit can be designed to impart a very significant buoyancy to the boat, so that the deck can hold heavy equipment such as that used in dock building. In another example, a summer camp can use a boat with multiple adjacent decks as a mobile swim platform, complete with a lifeguard stand, first aid kit, and hydration station for swimmers.

DETAILED DESCRIPTION OF THE DRAWINGS

Further embodiments of the present invention can be described by reference to the accompanying drawings.

Figure 2:
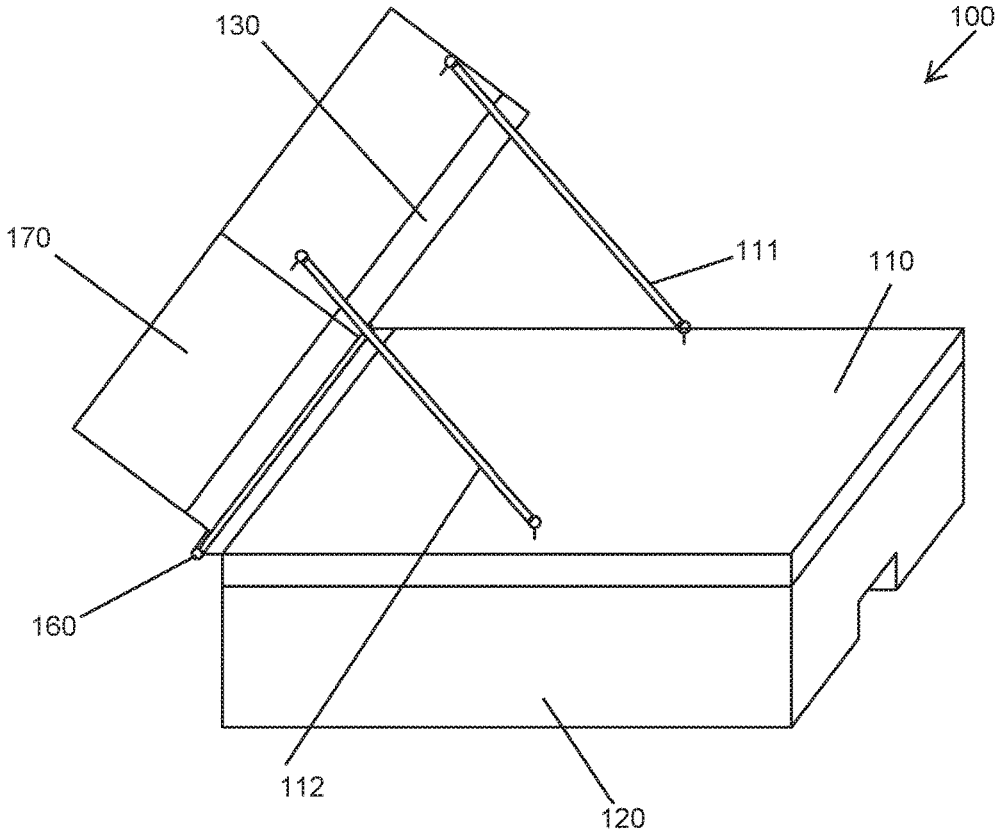
Figure 3:
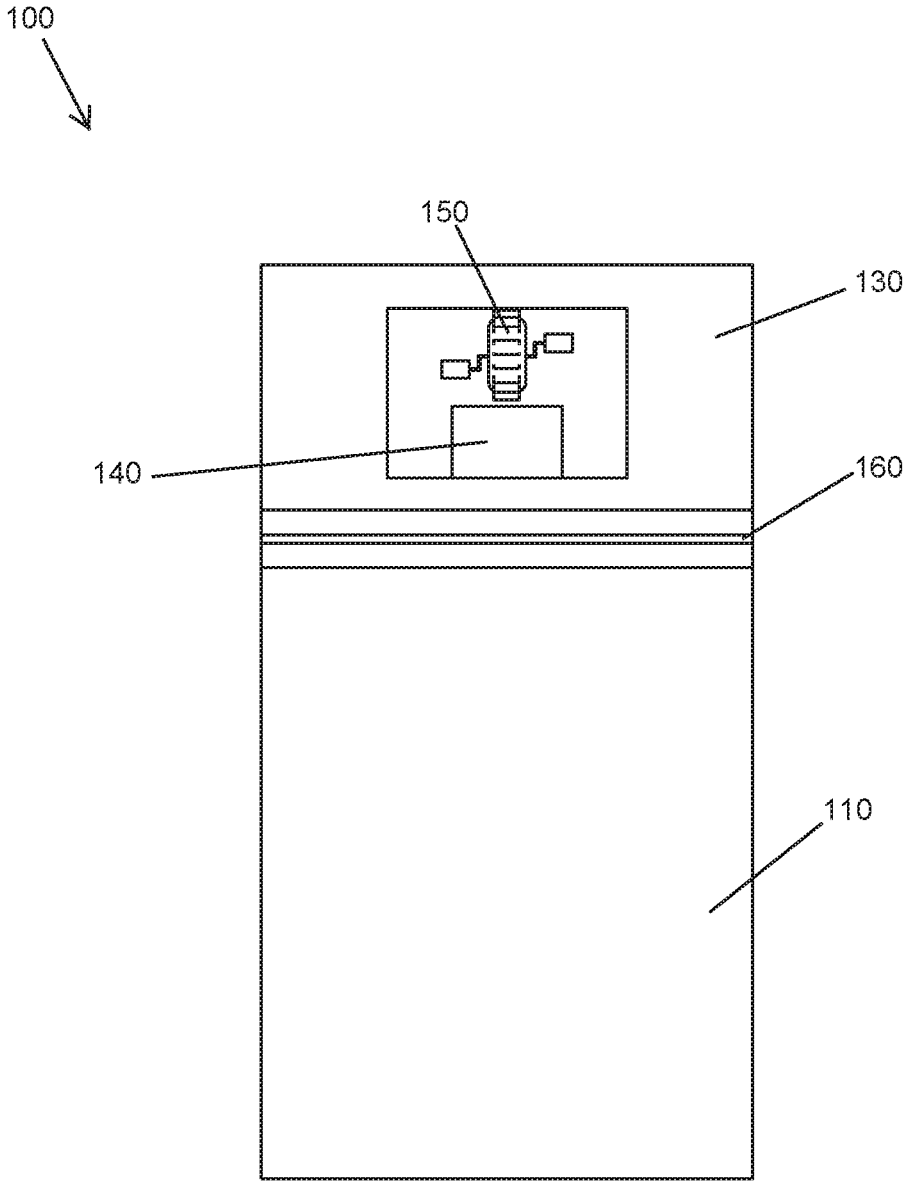

FIGS. 1-3 show, in one embodiment of the invention, boat 100. FIG. 1 provides a perspective view of boat 100 with paddle wheel cockpit 130 in the deployed position. FIG. 2 shows a perspective view of boat 100 with paddle wheel cockpit 130 folded over deck 110 in the stowed position. FIG. 3 provides a top plan view of boat 100 with paddle wheel cockpit 130 in the deployed position. Boat 100 comprises deck 110 supported by deck float 120. Paddle wheel cockpit 130 comprises a seat 140, which is proximal to pedal-driven paddle wheel 150, which is adapted to engage water and propel boat 100 when the boat is in water. Deck 110 and paddle wheel cockpit 130 are joined by cockpit hinge 160 that allows paddle wheel cockpit 130 to fold over deck 110, as shown in FIG. 2. Paddle wheel cockpit 130 is supported by cockpit float 170. Deck float 120 defines channel 180 that extends from pedal-driven paddle wheel 150 underneath the boat. FIG. 2 shows straps 111, 112 securing paddle wheel cockpit 130 in the stowed position.

Figure 4:
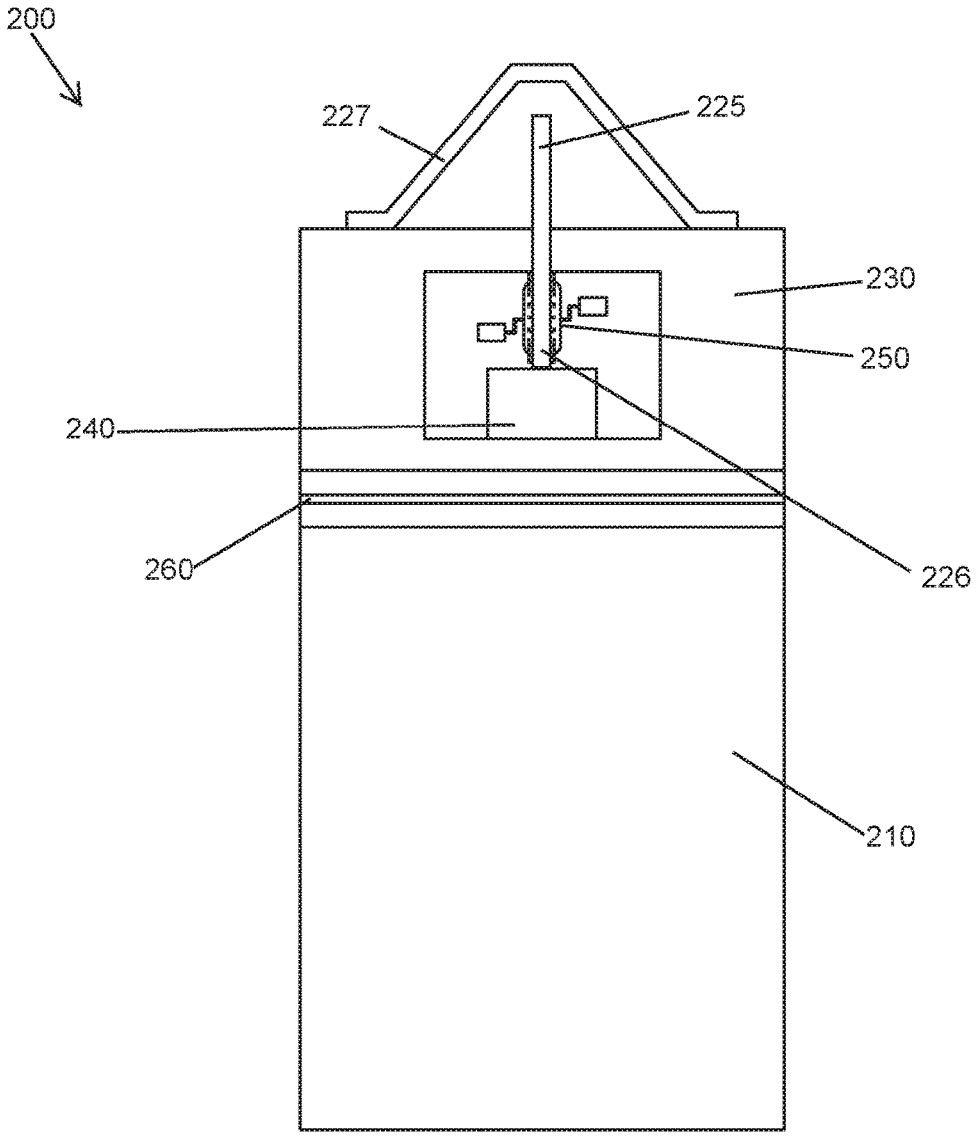
FIG. 4 shows another embodiment, boat 200.

FIG. 4 shows another embodiment, boat 200, in a top plan view. Boat 200 comprises deck 210 supported by one or more deck floats (not seen). Paddle wheel cockpit 230 comprises seat 240 proximal to pedal-driven paddle wheel 250 that is adapted to engage water and propel boat 200. Deck 210 and paddle wheel cockpit 230 are joined by cockpit hinge 260 that allows paddle wheel cockpit 230 to fold over deck 210. Boat 200 further comprises rudder to 25 joined to a tiller 226, which is positioned within arm's reach of seat 240. Rudder guard 227 protects rudder 225 from minor collisions.

Figure 5:
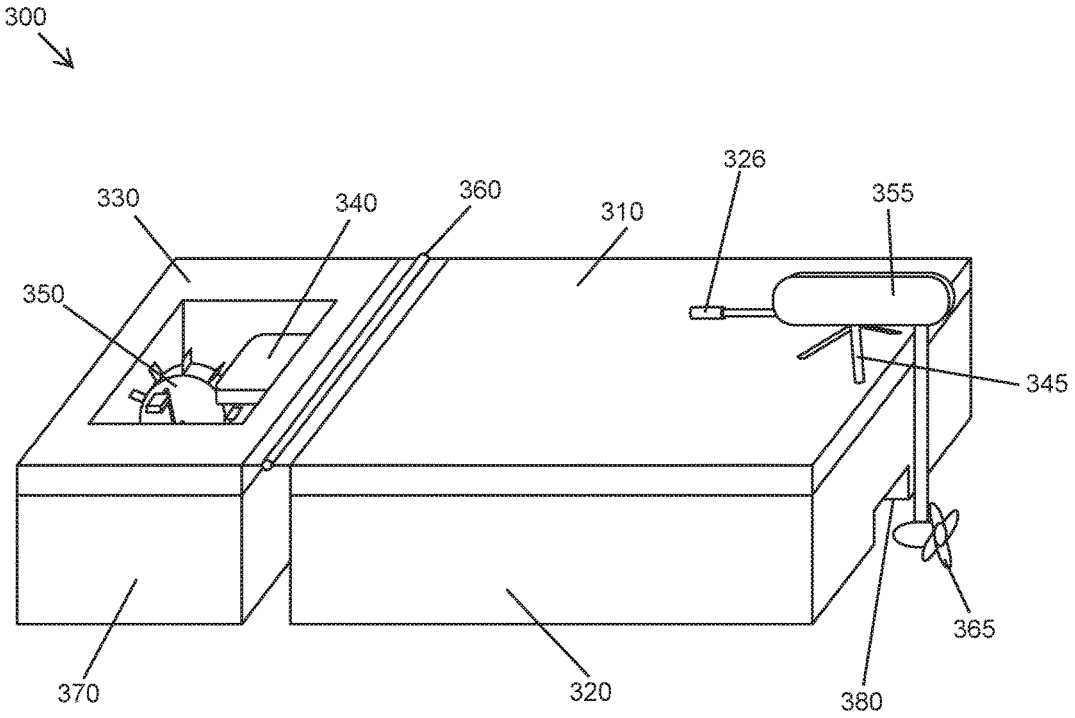
FIG. 5 shows a further embodiment, boat 300.

FIG. 5 shows a further embodiment, boat 300, in a perspective view. Boat 300 comprises deck 310 supported by deck float 320. Paddle wheel cockpit 330 comprises a seat 340 proximal to pedal-driven paddle wheel 350, which is adapted to engage water and propel the boat. Deck 310 and paddle wheel cockpit 330 are joined by cockpit hinge 360 that allows paddle wheel cockpit 330 to fold over deck 310. Paddle wheel cockpit 330 is supported by cockpit float 370. Deck float 320 defines channel 380 that extends from pedal-driven paddle wheel 350 underneath the boat. Boat 300 further comprises transom 345 adapted to support motor 355, which comprises throttle tiller 326 and propeller 365.

Figure 6:
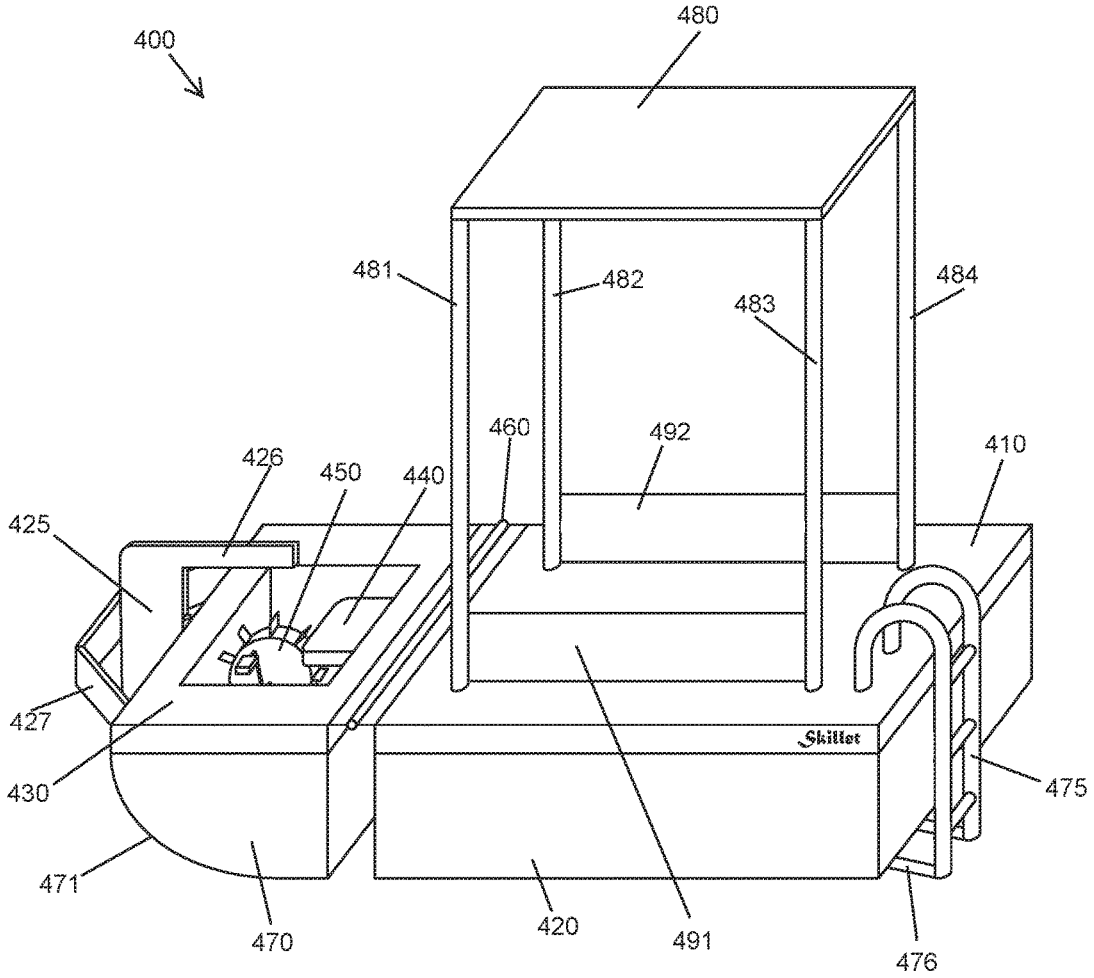
FIG. 6 shows an additional embodiment, boat 400.

FIG. 6 shows an additional embodiment, boat 400 in a perspective view. Boat 400 comprises deck 410 supported by deck float 420. Paddle wheel cockpit 430 comprises seat 440 proximal to pedal-driven paddle wheel 450, which is adapted to engage water and propel boat 400. Deck 410 and paddle wheel cockpit 430 are joined by cockpit hinge 460 that allows paddle wheel cockpit 430 to fold over deck 410. Paddle wheel cockpit 430 is supported by cockpit float 170, which has beveled leading edge 471 that allows easier movement through water when pedal-driven paddle wheel 450 is used. Boat 400 further comprises rudder 425 joined to tiller 426, which is positioned within arm's reach of seat 440. Rudder guard 427 protects rudder 425 from minor collisions. Boat 400 further comprises roof 480, which is supported by roof poles 481, 482, 483, 484. Deck 410 has receiving slots (not seen) that allow roof poles 481, 482, 483, 484, to engage deck 410 and support roof 480. Boat 400 further comprises walls 491, 492, which in this case are supported by roof poles 481, 483 for wall 491, and by roof poles 482, 484 for wall 492. Boat 400 further comprises ladder 475, which comprises ladder brace 476 that engages deck float 420 to stabilize ladder 475.

Figure 7:
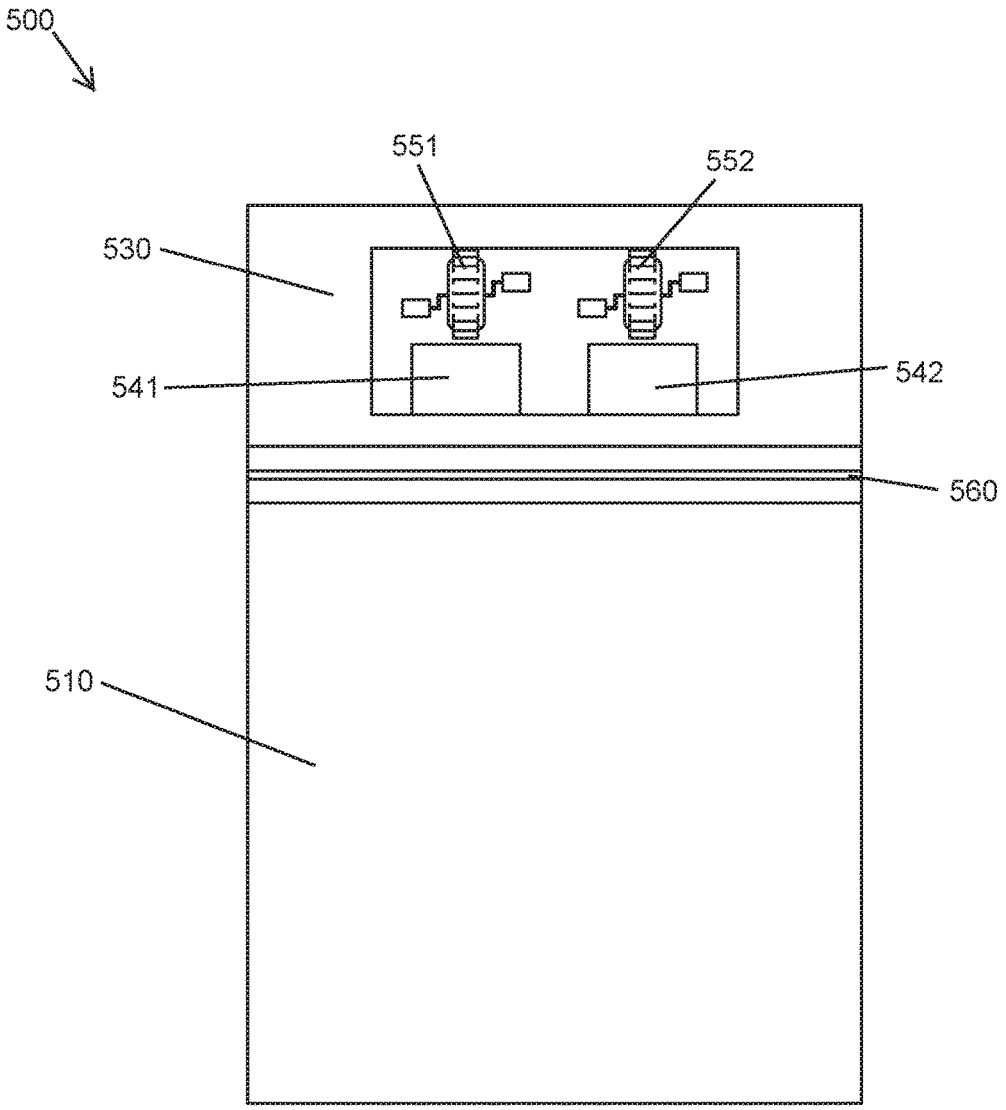
FIG. 7 shows a further embodiment, boat 500.

FIG. 7 shows a further embodiment, boat 500, in a top plan view. Boat 500 comprises deck 510 supported by one or more deck floats (not seen). Paddle wheel cockpit 130 comprises seat 541 and second seat 542. Seat 541 is proximal to pedal-driven paddle wheel 551, which is adapted to engage water and propel boat 500. Second seat 542 is proximal to a second pedal-driven paddle wheel 552, which is also adapted to engage water and propel boat 500. Cockpit hinge 560 joins paddle wheel cockpit 530 and deck 510, and allows paddle wheel cockpit 530 to fold over deck 510.

Figure 8:
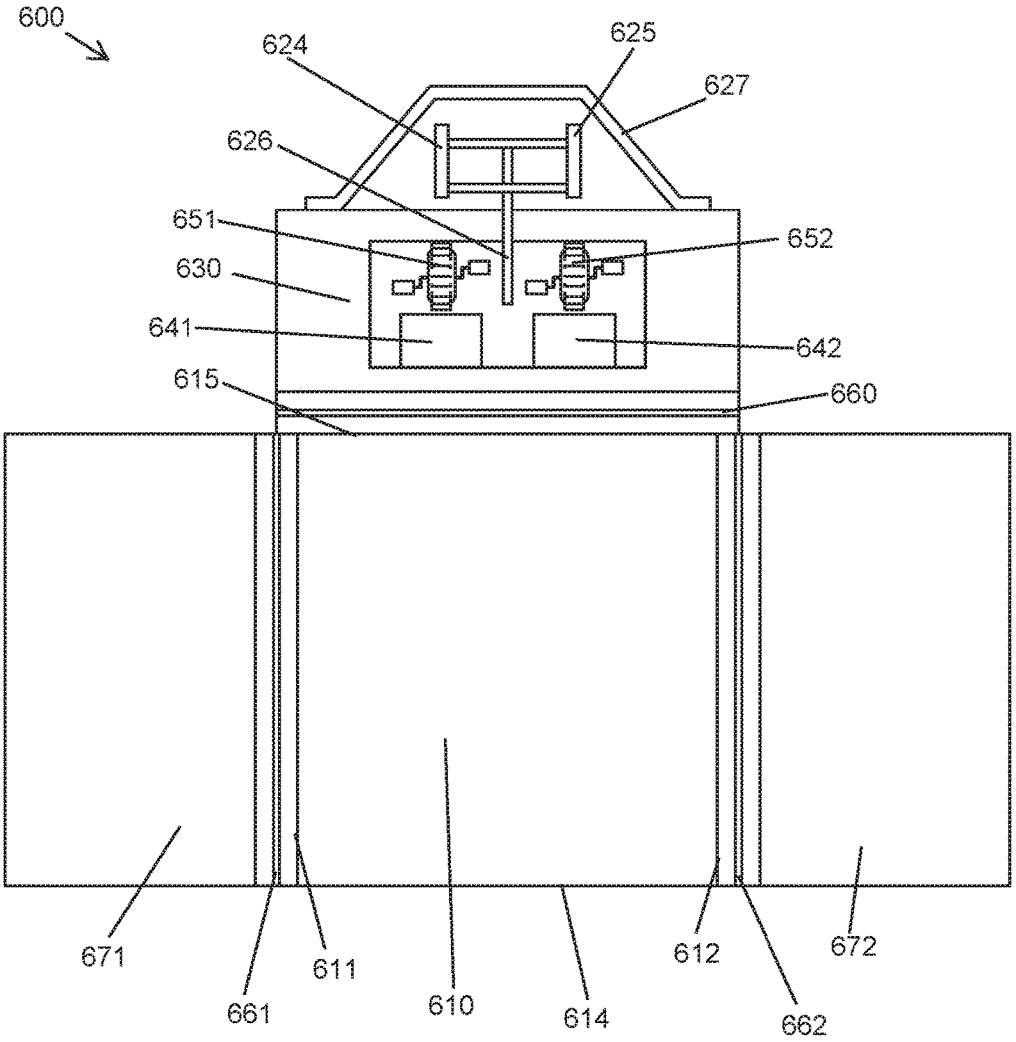
FIG. 8 shows an additional embodiment, boat 600.

FIG. 8 shows an additional embodiment, boat 600 in a top plan view. Boat 600 comprises central deck 610 supported by one or more deck floats (not seen), the central deck defining front edge 615 opposite rear edge 614, and left edge 611 opposite right edge 612 between front edge 615 and rear edge 614. Paddle wheel cockpit 630 comprises a plurality of seats 641, 642 and a plurality of pedal-driven paddle wheels 651, 652 adapted to engage water and propel. Seat 641 is proximal to pedal-driven paddle wheel 651. Seat 642 is proximal to pedal-driven paddle wheel 652. In this embodiment, there is an equal number of seats 641, 642 and pedal-driven paddle wheels 651, 652. Boat 600 further comprises left deck 671, which is supported by one or more left floats (not seen), and right deck 672 supported by one or more right floats (not seen). Paddle wheel cockpit 630 attaches to central deck 610 at front edge 615 by cockpit hinge 660, which allows paddle wheel cockpit 630 to fold over central deck 610. Left deck 671 attaches to central deck 610 at left edge 611 by left hinge 661, which allows left deck 671 to fold over central deck 610. Right deck 672 attaches to central deck 610 at right edge 612 by right hinge 662, which allows right deck 672 to fold over central deck 610. Boat 600 further comprises rudders 624, 625 joined to tiller 626, which is positioned within arm's reach of paddle wheel cockpit 630. Rudder guard 627 is positioned to protect rudders 624, 625 from minor collisions.

Figure 9:
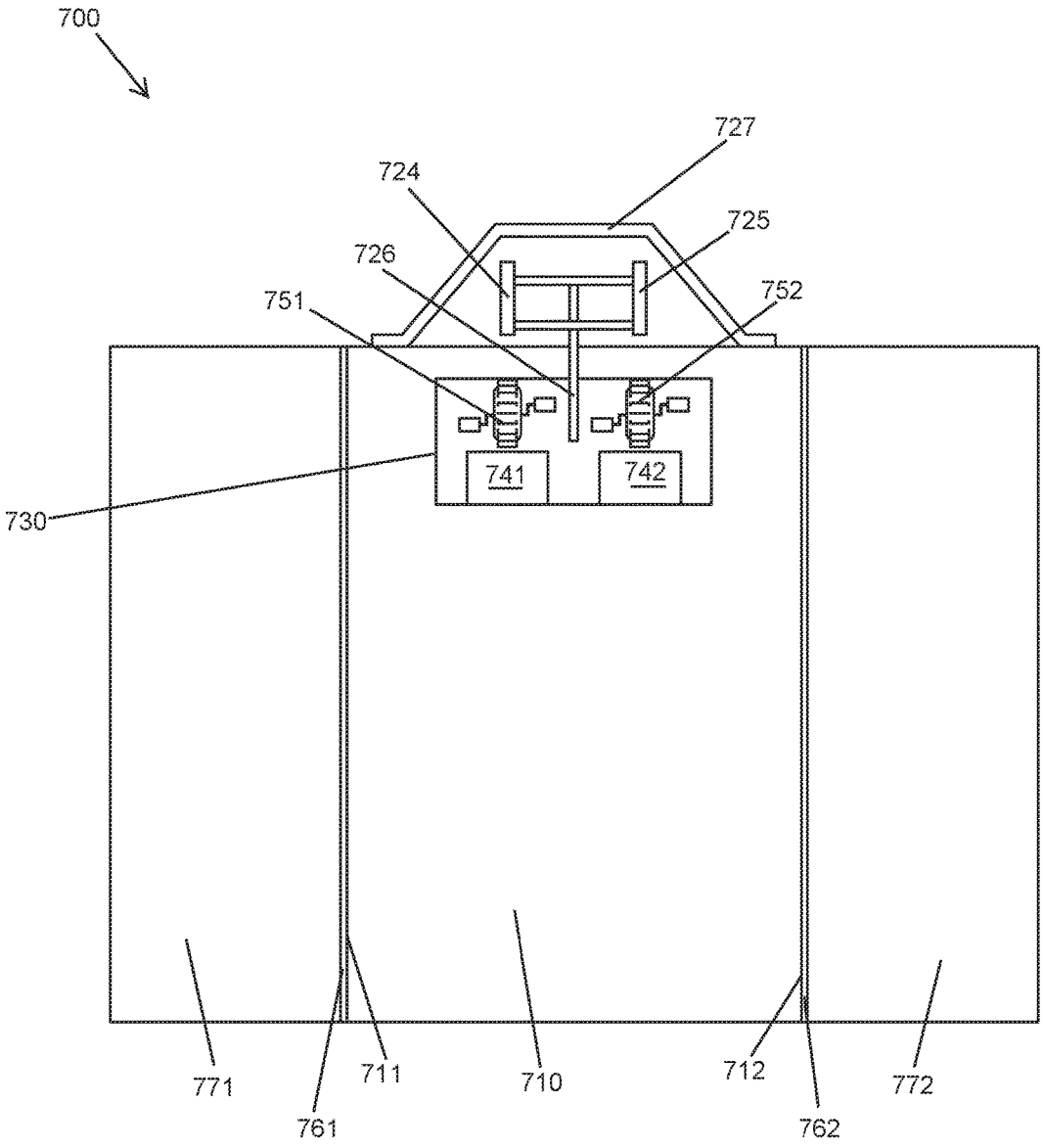
FIGS. 9-11 shows yet another embodiment, boat 700.
Figure 10:
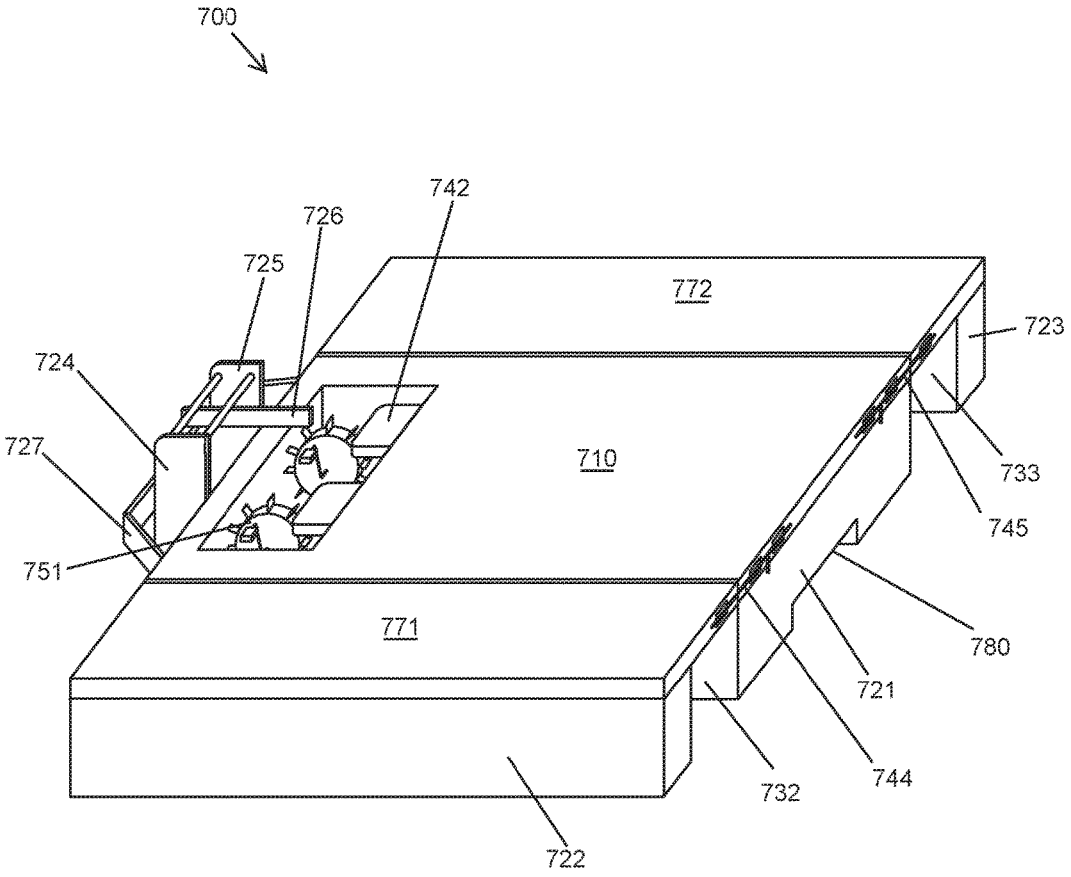
Figure 11:
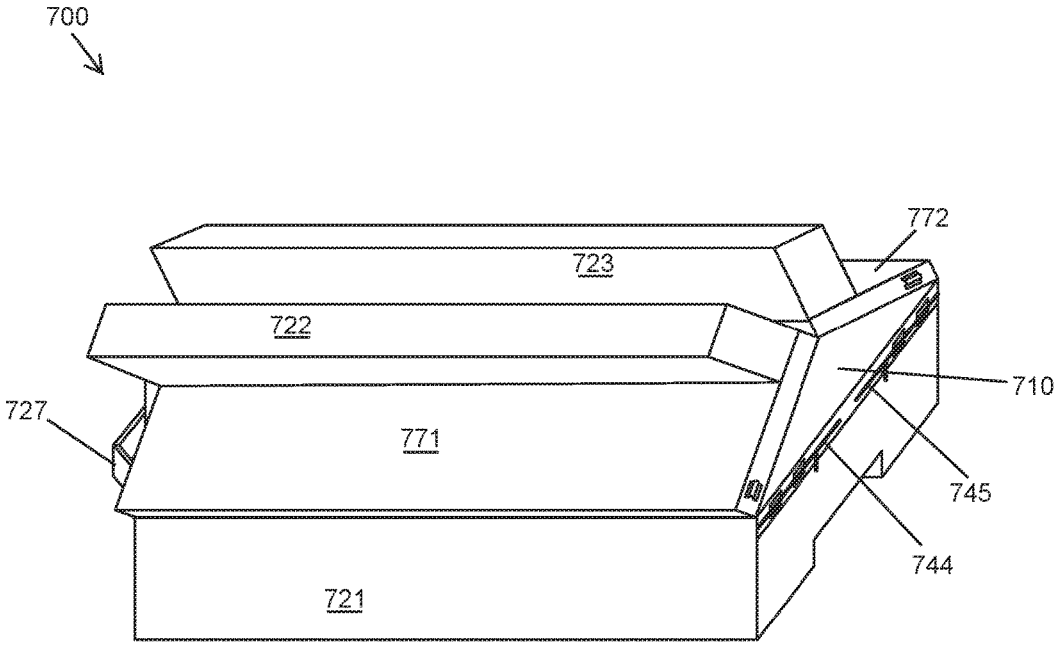

FIGS. 9-11 shows yet another embodiment, boat 700. FIG. 9 shows boat 700 in a top plan view with left deck 771 and right deck 772 in the deployed position. FIG. 10 shows boat 700 in the same configuration from a perspective view. FIG. 11 shows boat 700 in a perspective view, but with left deck 771 and right deck 772 in the stowed position. Boat 700 comprises central deck 710 supported by deck float 721. Central deck 710 further comprises paddle wheel cockpit 730, which has a plurality of seats 741, 742 and a plurality of pedal-driven paddle wheels 751, 752 which are adapted to engage water and propel boat 700. Seat 741 is proximal to pedal-driven paddle wheel 751. Seat 742 is proximal to pedal driven paddle wheel 752. In this example, there are an equal number of seats 741, 742 and pedal-driven paddle wheels 751, 752 in paddle wheel cockpit 730. Boat 700 further comprises rudders 724, 725, which are connected to tiller 726 which is positioned within arm's reach of both seats 741, 742. Rudder guard 727 protects rudders 724, 725 from minor collisions. Central deck 710 has left edge 711, and right edge 712. Left deck 771 is attached to central deck 710 at left edge 711 by left hinge 761, which allows left deck 771 to fold over central deck 710, as shown in FIG. 11. Right deck 772 is attached to central deck 710 at right edge 712 by right hinge 762, which allows right deck 772 to fold over central deck 710, as shown in FIG. 11.

Left deck 771 is supported by left float 722. Right deck 772 is supported by right float 723. Deck float 721 defines channel 780 that extends from the plurality of pedal-driven paddle wheels 751, 752 underneath boat 700. Left float 722 and deck float 721 define left channel 732 that extends underneath boat 700. Right float 723 and deck float 721 define right channel 733 that extends underneath boat 700. Locking bar 744 secures left deck 771 in a deployed position relative to central deck 710 in FIG. 10. Locking bar 745 secures right deck 772 in a deployed position relative to central deck 710 in FIG. 10. In FIG. 11, locking bars 744, 745 are retracted to allow left deck 771 and right deck 772 to fold over central deck 710 in a stowed position.

Figure 12:
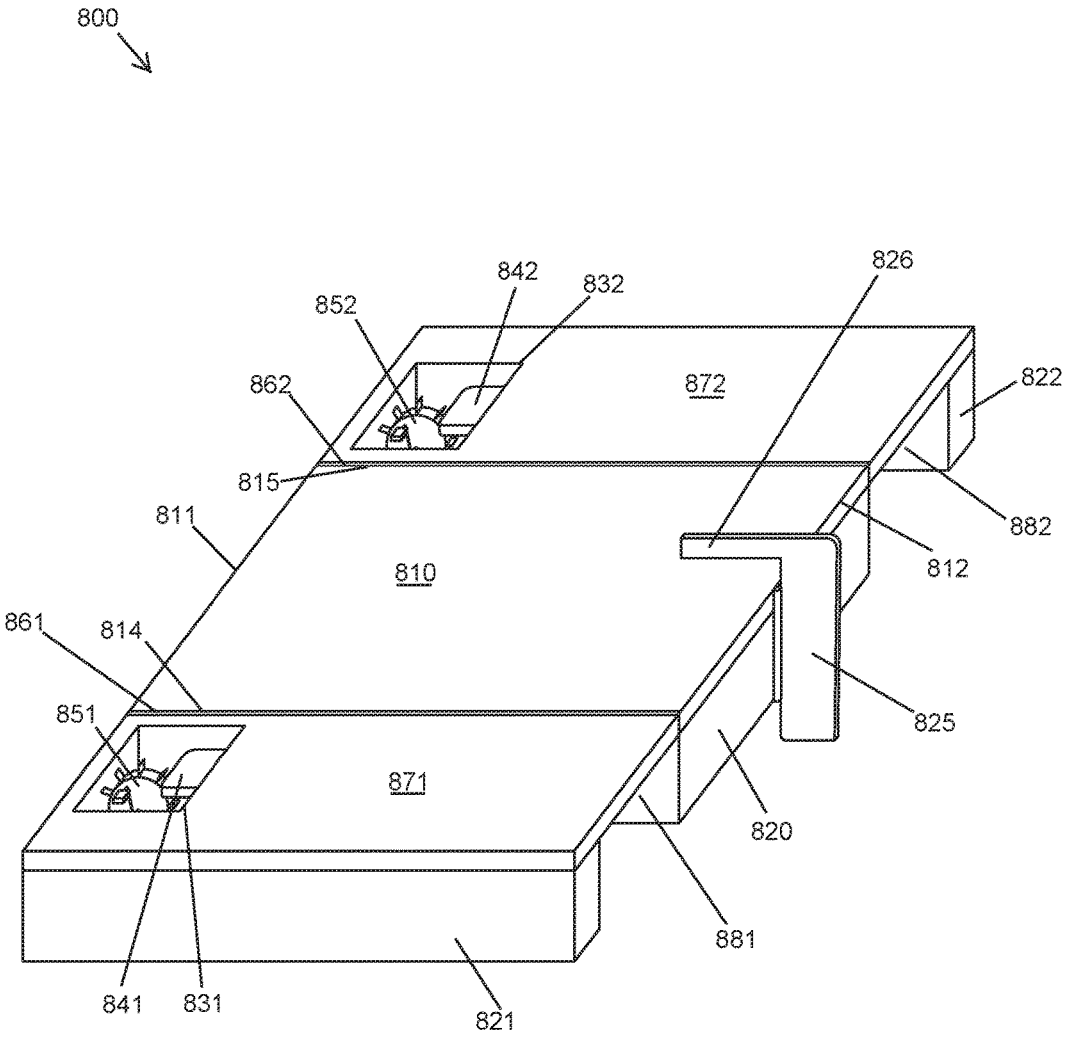
FIG. 12 shows a further embodiment, boat 800.

FIG. 12 shows a further embodiment, boat 800. Boat 800 comprises central deck 810 supported by deck float 820. Central deck 810 has front edge 811, rear edge 812, and left edge 814 opposite right edge 815. Left deck 871 is supported by left float 821, and further comprises left cockpit 831. Left cockpit 831 comprises left seat 841 which is proximal to left pedal-driven paddle wheel 851, which is adapted to engage water and propel boat 800. Right deck 872 is supported by right float 822, and further comprises right cockpit 832. Right cockpit 832 comprises right seat 842 which is proximal to right pedal-driven paddle wheel 852, which is adapted to engage water and propel boat 800. Left deck 871 attaches to central deck 810 at left edge 814 by left hinge 861, which allows left deck 871 to fold over central deck 810. Right deck 872 attaches to central deck 810 at right edge 815 by right hinge 862, which allows right deck 872 to fold over central deck 810.

Left float 821 and deck float 820 define left channel 881 that extends from left pedal-driven paddle wheel 851 underneath boat 800. Right float 822 and deck float 820 define right channel 882 that extends from right pedal-driven paddle wheel 852 underneath boat 800. Boat 800 further comprises rudder 825 positioned at rear edge 812. Rudder 825 is connected to tiller 826, which is accessible to a person located near the rear edge 812 of central deck 810.

Figure 13:
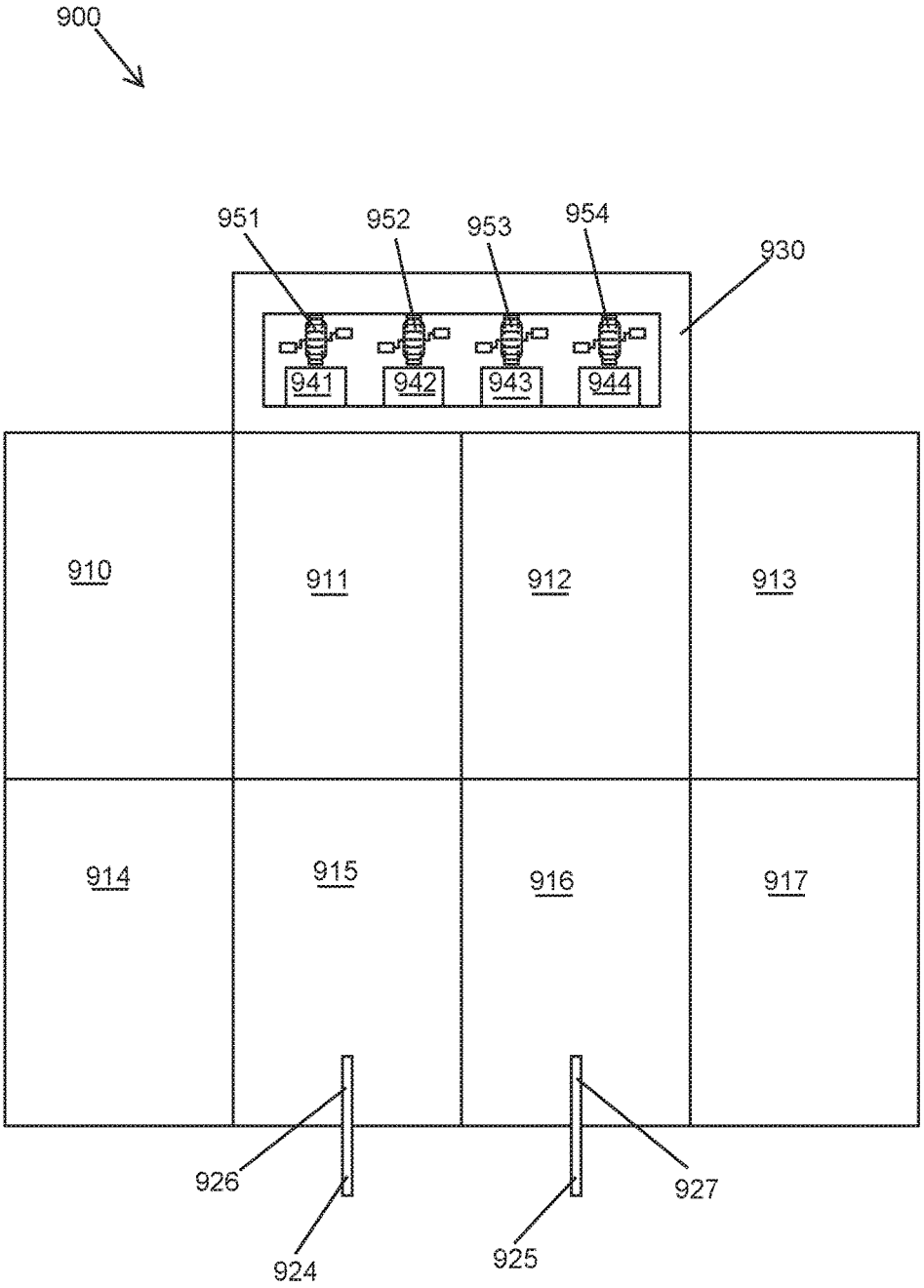
FIG. 13 shows an additional embodiment, boat 900.

FIG. 13 shows an additional embodiment, boat 900 in a top plan view. Boat 900 comprises a plurality of decks 910, 911, 912, 913, 914, 915, 916, and 917, each of those decks joined to at least one other deck in the plurality of decks. Boat 900 further comprises paddle wheel cockpit 930 joined to decks 911, 912. Paddle wheel cockpit 930 comprises seats 941, 942, 943, 944, each of which is proximal to paddle-driven paddle wheels 951, 952, 953, 954, respectively. Boat 900 further comprises rudders 924, 925, each of which are joined with tillers 926, 927, respectively. Optionally, tillers 926, 927 can be joined so that one person can operate both rudders 924, 925. Decks 910-917 and paddle wheel cockpit 930 can be joined in any suitable manner. Hinges that allow two or more decks to fold over each other can be used. Bolts or other fasteners that allow permanent or temporary connection between one or more of decks 910-917 and/or cockpit 930 also may be mentioned.

Figure 14:
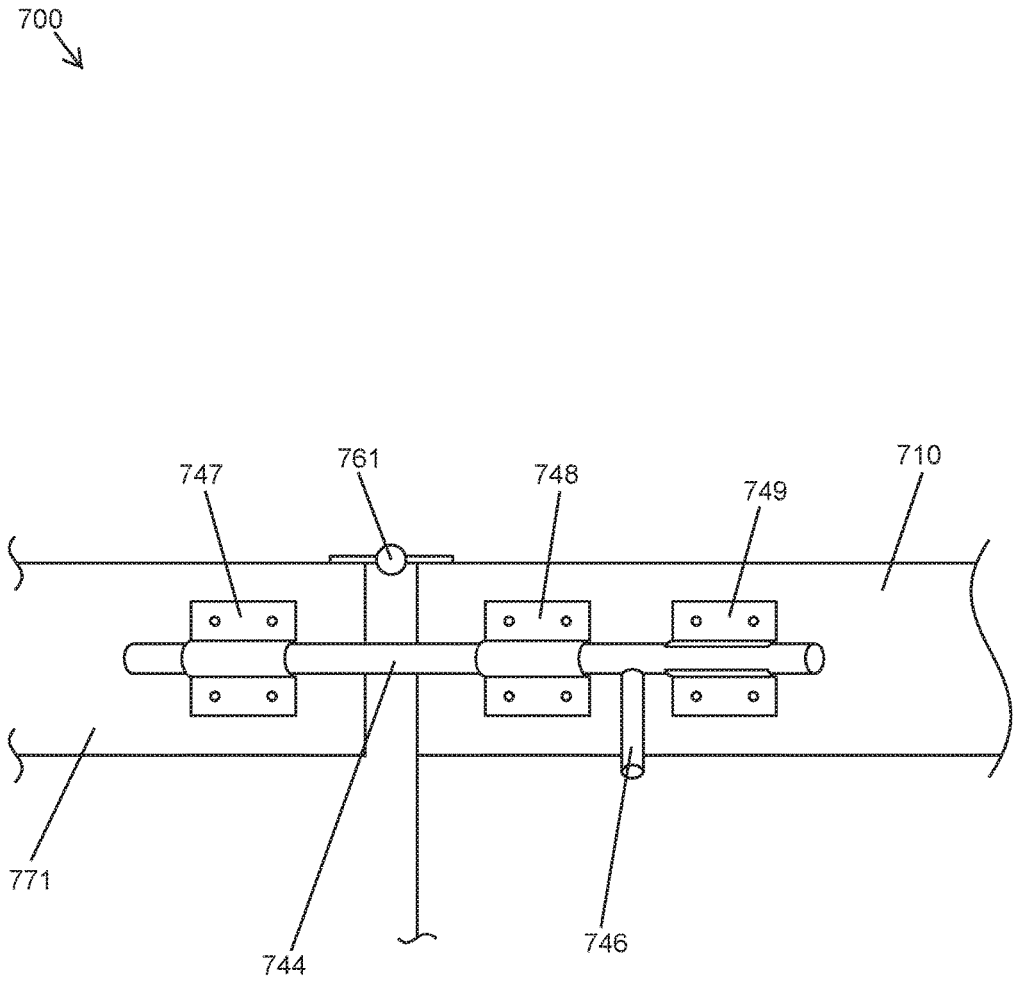
FIG. 14 shows locking bar 744 in a partial view of boat 700.

FIG. 14 shows locking bar 744 in a partial view of boat 700. Left deck 771 is secured in a deployed position relative to central deck 710 with locking bar 744 engaging bracket 747. Brackets 748, 749 also stabilize locking bar and secure it to central deck 710. Locking bar 744 is operated by maneuvering handle 746 through bracket 749.

Figure 15:
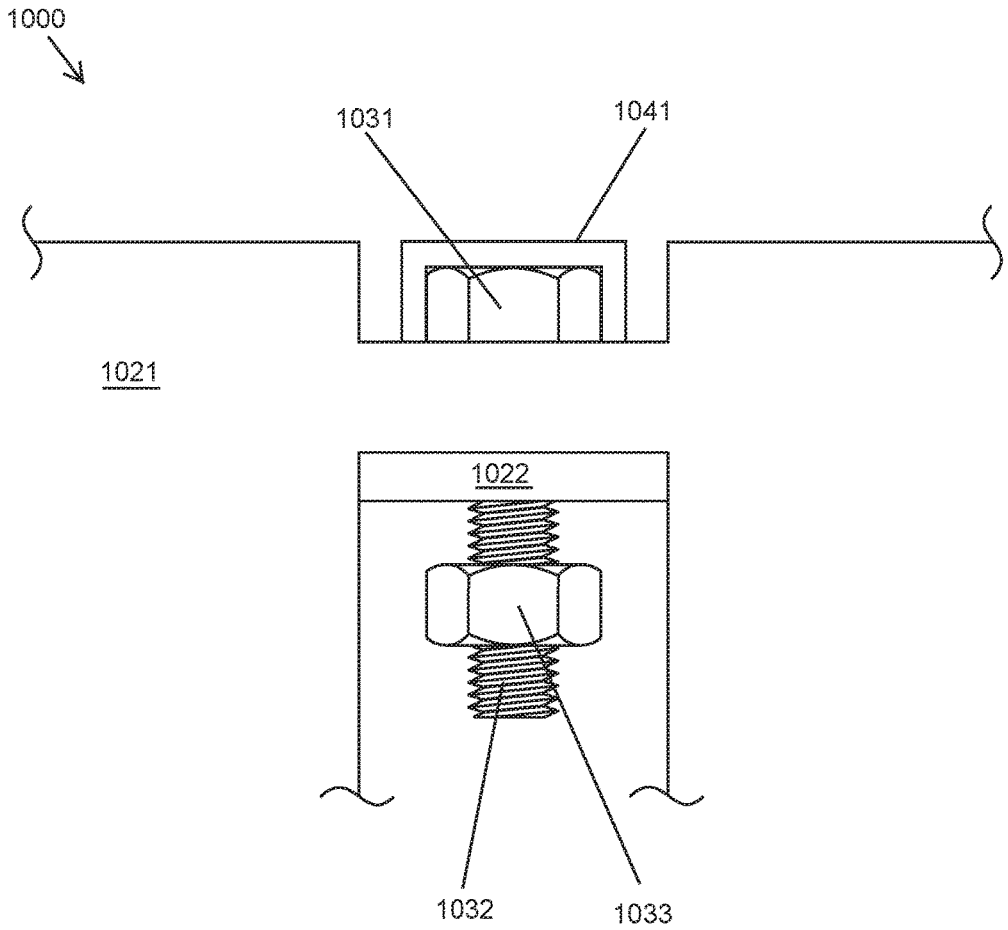
FIG. 15 shows bolt 1032 in a partial view of boat 1000.

FIG. 15 shows bolt 1032 in a partial view of boat 1000 in a partial cut away side view. Boat 1000, being an embodiment of the present invention, attaches element 1021 with element 1022. Elements 1021 and 1022 can be any suitable components, such as, for example, decks, hinges, and accessories. To reduce any tripping hazard, bolt 1032 comprises head 1031 covered by cap 1041. Cap 1041 can be made of any suitable material, such as, for example, polymer. Nut 1033 can be tightened against element 1022 to secure the connection.

Figure 16:
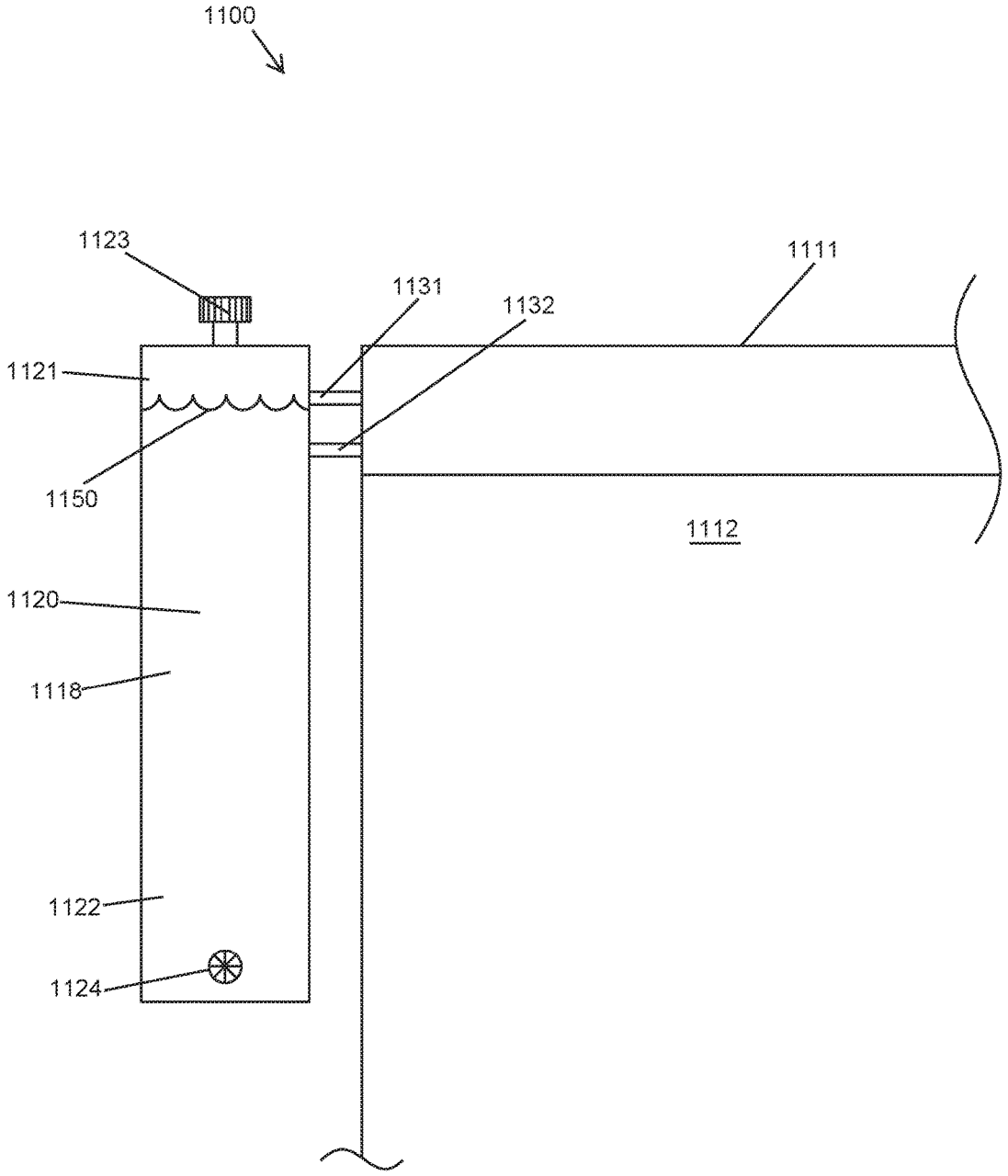
FIG. 16 shows ballast tank 1120 in a partial view of boat 1100.

FIG. 16 shows ballast tank 1120 in a partial view of boat 1100. Ballast tank 1120 comprises enclosed volume 1118 for holding water, and has an upper portion 1121 and a lower portion 1122. Input port 1123 allows for the addition of water at upper portion 1121, while outlet port 1124 allows for draining water from lower portion 1122. Braces 1131, 1132 secure ballast tank 1120 to deck 1111, which is supported by deck float 1112 of boat 1100. Water level 1150 can be raised or lowered depending on the need for greater or lesser ballast.

EMBODIMENTS

Embodiment 1

A boat, comprising:

a deck supported by one or more deck floats, and a paddle wheel cockpit comprising a seat proximal to a pedal-driven paddle wheel adapted to engage water and propel the boat;

wherein the deck and the paddle wheel cockpit are joined by at least one cockpit hinge that allows the paddle wheel cockpit to fold over the deck.

Embodiment 2

The boat of embodiment 1, wherein the paddle wheel cockpit is supported by one or more cockpit floats.

Embodiment 3

The boat of any one of embodiments 1-2, further comprising at least one rudder joined to a tiller positioned within arm's reach of the seat.

Embodiment 4

The boat of embodiment 3, further comprising a rudder guard positioned to protect the at least one rudder.

Embodiment 5

The boat of any one of embodiments 1-4, wherein the one or more deck floats define a channel that extends from the pedal-driven paddle wheel underneath the boat.

Embodiment 6

The boat of any one of embodiments 1-5, further comprising a ladder extending from the deck, the ladder comprising a ladder brace that engages the one or more deck floats to stabilize the ladder.

Embodiment 7

The boat of any one of embodiments 1-6, further comprising a roof attached to and covering at least a portion of the deck.

Embodiment 8

The boat of any one of embodiments 1-7, further comprising at least one locking bar adapted to secure the paddle wheel cockpit relative to the deck in a deployed position.

Embodiment 9

The boat of any one of embodiments 1-8, further comprising a transom adapted to support an electric motor, an outboard motor, or both.

Embodiment 10

The boat of embodiment 9, wherein the transom is located on the deck, on the paddle wheel cockpit, or both.

Embodiment 11

The boat of any one of embodiments 1-10, wherein the boat comprises wood, polymer, metal, or combinations thereof.

Embodiment 12

The boat of embodiment 11, wherein the wood comprises teak.

Embodiment 13

The boat of any one of embodiments 11-12, wherein the polymer comprises high density polyethylene.

Embodiment 14

The boat of any one of embodiments 11-13, wherein the metal comprises stainless steel, aluminum, or combinations thereof.

Embodiment 15

The boat of any one of embodiments 1-14, wherein the paddlewheel cockpit comprises a second seat proximal to a second pedal-driven paddle wheel adapted to engage water and propel the boat.

Embodiment 16

The boat of embodiment 15, further comprising a double rudder joined to a tiller positioned within arm's reach of the seat, the second seat, or both.

Embodiment 17

The boat of any one of embodiments 15-16, wherein the one or more deck floats define a channel that extends from the pedal-driven paddle wheel and the second pedal-driven paddle wheel underneath the boat.

Embodiment 18

The boat of any one of embodiments 15-17, wherein the one or more deck floats define a first channel that extends from the pedal-driven paddle wheel underneath the boat, and a second channel that extends from the second pedal-driven paddle wheel underneath the boat.

Embodiment 19

A boat, comprising:

a central deck supported by one or more deck floats, the central deck comprising a paddle wheel cockpit having a plurality of seats and a plurality of pedal-driven paddle wheels adapted to engage water and propel the boat, each seat in the plurality of seats being proximal to one pedal-driven paddle wheel in the plurality of pedal-driven paddle wheels, optionally there being an equal number of seats and pedal-driven paddle wheels;

one or more rudders positioned to navigate the boat, the one or more rudders being connected to at least one tiller positioned within arm's reach of at least one seat in the plurality of seats or within arm's reach of a person on the central deck, or both;

the central deck having a left edge and a right edge;

a left deck supported by one or more left floats;

a right deck supported by one or more right floats;

wherein the left deck attaches to the central deck at the left edge by at least one left hinge that allows the left deck to fold over the central deck; and wherein the right deck attaches to the central deck at the right edge by at least one right hinge that allows the right deck to fold over the central deck.

Embodiment 20

The boat of embodiment 19, further comprising at least one rudder guard positioned to protect the one or more rudders.

Embodiment 21

The boat of any one of embodiments 19-20, wherein the one or more deck floats, one or more left floats, one or more right floats, or a combination thereof, define one or more channels that extend from the plurality of pedal-driven paddle wheels underneath the boat.

Embodiment 22

A boat, comprising:

a central deck supported by one or more deck floats, the central deck defining a front edge opposite a rear edge, and a left edge opposite a right edge and between the front edge and the rear edge;

a paddle wheel cockpit comprising a plurality of seats and a plurality of pedal-driven paddle wheels adapted to engage water and propel the boat, each seat in the plurality of seats being proximal to one pedal-driven paddle wheel in the plurality of pedal-driven paddle wheels, optionally there being an equal number of seats and pedal-driven paddle wheels;

a left deck supported by one or more left floats; and a right deck supported by one or more right floats;

wherein the paddle wheel cockpit attaches to the central deck at the front edge or the rear edge by at least one cockpit hinge that allows the paddle wheel cockpit to fold over the central deck;

wherein the left deck attaches to the central deck at the left edge by at least one left hinge that allows the left deck to fold over the central deck; and wherein the right deck attaches to the central deck at the right edge by at least one right hinge that allows the right deck to fold over the central deck.

Embodiment 23

The boat of embodiment 22, wherein the paddle wheel cockpit is supported by one or more cockpit floats.

Embodiment 24

The boat of any one of embodiments 22-23, further comprising at least one rudder joined to a tiller positioned within arm's reach of the paddle wheel cockpit.

Embodiment 25

The boat of embodiment 24, further comprising a rudder guard positioned to protect the at least one rudder.

Embodiment 26

The boat of any one of embodiments 22-25, wherein the one or more deck floats define at least one channel that extends from the plurality of pedal-driven paddle wheels underneath the boat.

Embodiment 27

The boat of any one of embodiments 22-26, further comprising at least one ladder extending from the central deck, the left deck, the right deck, or a combination thereof, the at least one ladder comprising a ladder brace that engages the one or more deck floats, one or more left floats, one or more right floats, or a combination thereof to stabilize the at least one ladder.

Embodiment 28

The boat of any one of embodiments 22-27, further comprising a roof attached to and covering at least a portion of the central deck.

Embodiment 29

The boat of any one of embodiments 22-28, further comprising at least one locking bar adapted to secure the paddle wheel cockpit, the left deck, and the right deck relative to the central deck in a deployed position.

Embodiment 30

The boat of any one of embodiments 22-29, further comprising a transom adapted to support an electric motor, an outboard motor, or both.

Embodiment 31

The boat of embodiment 30, wherein the transom is located on the central deck, on the left deck, on the right deck, on the paddle wheel cockpit, or on a combination thereof.

Embodiment 32

The boat of any one of embodiments 22-31, wherein the boat comprises wood, polymer, metal, or combinations thereof.

Embodiment 33

The boat of embodiment 32, wherein the wood comprises teak.

Embodiment 34

The boat of any one of embodiments 32-33, wherein the polymer comprises high density polyethylene.

Embodiment 35

The boat of any one of embodiments 32-34, wherein the metal comprises stainless steel, aluminum, or combinations thereof.

Embodiment 36

A boat, comprising:

a central deck supported by one or more deck floats, the central deck defining a front edge opposite a rear edge, and a left edge opposite a right edge and between the front edge and the rear edge;

a left deck supported by one or more left floats, the left deck further comprising a left cockpit comprising at least one left seat proximal to at least one left pedal-driven paddle wheel adapted to engage water and propel the boat;

a right deck supported by one or more right floats, the right deck further comprising a right cockpit comprising at least one right seat proximal to at least one right pedal-driven paddle wheel adapted to engage water and propel the boat;

wherein the left deck attaches to the central deck at the left edge by at least one left hinge that allows the left deck to fold over the central deck; and wherein the right deck attaches to the central deck at the right edge by at least one right hinge that allows the right deck to fold over the central deck.

Embodiment 37

The boat of embodiment 36, wherein the one or more deck floats, one or more left floats, one or more right floats, or a combination thereof, define a left channel that extends from the at least one left pedal-driven paddle wheel underneath the boat, and a right channel that extends from the at least one right pedal-driven paddle wheel underneath the boat.

Embodiment 38

The boat of any one of embodiments 36-37, further comprising at least one rudder positioned at the rear edge.

Embodiment 39

A boat, comprising:

a plurality of decks supported by a plurality of deck floats, each deck in the plurality of decks joined to at least one other deck in the plurality of decks;

a paddle wheel cockpit comprising one or more seats proximal to one or more pedal-driven paddle wheels, the paddle wheel cockpit being connected to at least one deck in the plurality of decks.

Embodiment 40

The boat of embodiment 39, further comprising at least one rudder attached to at least one deck for the navigation of the boat.

Embodiment 41

The boat of any one of embodiments 39-40, further comprising at least one transom adapted to support an electric motor, an outboard motor, or both.

Embodiment 42

The boat of any one of embodiments 39-41, wherein at least two decks in the plurality of decks are joined by at least one hinge.

Embodiment 43

The boat of any one of embodiments 39-42, wherein the paddle wheel cockpit is joined to at least one deck in the plurality of decks by at least one hinge.

Embodiment 44

The boat of any one of embodiments 1-43, further comprising at least one ballast tank, the ballast tank comprising:
an enclosed volume for holding water, the enclosed volume having an upper portion and a lower portion;
an input port for adding water at the upper portion;
an outlet port for draining water from the lower portion; and
at least one brace for attaching the ballast tank to the boat.

Embodiment 45

The boat of any one of embodiments 1-44, further comprising at least one wall attached temporarily or permanently to the deck, the paddle wheel cockpit, or both.

As previously stated, detailed embodiments of the present invention are disclosed herein; however, it is to be understood that the disclosed embodiments are merely exemplary of the invention that may be embodied in various forms. It will be appreciated that many modifications and other variations stand within the intended scope of this invention as claimed below. Furthermore, the foregoing description of various embodiments does not necessarily imply exclusion. For example, "some" embodiments may include all or part of "other" and "further" embodiments within the scope of this invention. In addition, "a" does not mean "one and only one;" "a" can mean "one and more than one."

I claim:

1. A boat, comprising:
a deck supported by one or more deck floats, and
a paddle wheel cockpit comprising a seat proximal to a pedal-driven paddle wheel adapted to engage water and propel the boat;
wherein the deck and the paddle wheel cockpit are joined by at least one cockpit hinge that allows the paddle wheel cockpit to fold over the deck;
the boat further comprising at least one ballast tank, the ballast tank comprising:
an enclosed volume for holding water, the enclosed volume having an upper portion and a lower portion;
an input port for adding water at the upper portion;
an outlet port for draining water from the lower portion; and
at least one brace for attaching the ballast tank to the boat.

2. The boat of claim 1, wherein the paddle wheel cockpit is supported by one or more cockpit floats.

3. The boat of claim 1, further comprising at least one rudder joined to a tiller positioned within arm's reach of the seat.

4. The boat of claim 3, further comprising a rudder guard positioned to protect the at least one rudder.

5. The boat of claim 1, wherein the one or more deck floats define a channel that extends from the pedal-driven paddle wheel underneath the boat.

6. The boat of claim 1, further comprising a ladder extending from the deck, the ladder comprising a ladder brace that engages the one or more deck floats to stabilize the ladder.

7. The boat of claim 1, further comprising a roof attached to and covering at least a portion of the deck.

8. The boat of claim 1, further comprising at least one locking bar adapted to secure the paddle wheel cockpit relative to the deck in a deployed position.

9. The boat of claim 1, further comprising a transom adapted to support an electric motor, an outboard motor, or both.

10. The boat of claim 9, wherein the transom is located on the deck, on the paddle wheel cockpit, or both.

11. The boat of claim 1, wherein the boat comprises wood, polymer, metal, or combinations thereof.

12. The boat of claim 11, wherein the wood comprises teak.

13. The boat of claim 11, wherein the polymer comprises polyethylene.

14. The boat of claim 11, wherein the metal comprises stainless steel, aluminum, or combinations thereof.

15. The boat of claim 1, wherein the paddlewheel cockpit comprises a second seat proximal to a second pedal-driven paddle wheel adapted to engage water and propel the boat.

16. The boat of claim 15, further comprising a double rudder joined to a tiller positioned within arm's reach of the seat, the second seat, or both.

17. The boat of claim 15, wherein the one or more deck floats define a channel that extends from the pedal-driven paddle wheel and the second pedal-driven paddle wheel underneath the boat.

18. The boat of claim 15, wherein the one or more deck floats define a first channel that extends from the pedal-driven paddle wheel underneath the boat, and a second channel that extends from the second pedal-driven paddle wheel underneath the boat.

* * * * *